US005725401A

United States Patent [19]

Smith

[11] Patent Number: 5,725,401

[45] Date of Patent: Mar. 10, 1998

[54] TROLL MOTOR TILT TRIGGER

[76] Inventor: Nolan A. Smith, 16037 E. Sunflower Trial, Orlando, Fla. 32828

[21] Appl. No.: 835,648

[22] Filed: Apr. 10, 1997

[51] Int. Cl.[6] ..... B63H 5/125

[52] U.S. Cl. ..... 440/6; 440/62

[58] Field of Search ..... 440/6, 7, 49, 53, 440/58, 62, 63

[56] References Cited

U.S. PATENT DOCUMENTS

| | | | |
|---|---|---|---|
| 351,135 | 10/1886 | Sylven | 440/62 |
| 3,424,412 | 1/1969 | Gayle | 248/4 |
| 3,461,832 | 8/1969 | Vierling | 115/41 |
| 3,578,277 | 5/1971 | Osborn | 248/4 |
| 3,674,228 | 7/1972 | Horton | 248/4 |
| 3,724,790 | 4/1973 | Harris et al. | 248/4 |
| 3,765,369 | 10/1973 | Henning | 115/17 |
| 3,861,628 | 1/1975 | Krieger | 248/4 |
| 3,954,080 | 5/1976 | Weaver | 115/17 |
| 3,965,844 | 6/1976 | Brock et al. | 440/6 |
| 4,033,530 | 7/1977 | Harris | 248/4 |
| 4,386,918 | 6/1983 | Matthew, et al. | 440/7 |
| 4,734,068 | 3/1988 | Edwards | 440/56 |
| 4,781,633 | 11/1988 | Hunt | 440/62 |
| 5,171,174 | 12/1992 | Mynster | 440/7 |

*Primary Examiner*—Stephen Avila
*Attorney, Agent, or Firm*—Edward M. Livingston, Esq.

[57] ABSTRACT

A trigger lever (1) is attached pivotally at a fulcrum section (4) to an outside portion of a steering housing (9) that tilts on a troll-motor clamp (11) of a conventional troll-motor assembly. A latch-release line (5) that is pulled from a select position on a steering handle (7) presses a press end (25) of a latch-release rod (23) to release a cross-bar latch (22) from engagement with ratchet slots (20) in quarter-circle edges of juxtaposed ratchet plates (17). This allows tilting of a troll-motor rod (8) to maneuver water obstacles without an operator's having either to stand, bend over or otherwise make inconvenient movements that endanger boat stability, to free both hands or to apply distracting mental effort. Aiding in this convenient, one-handled, sitting-position tilting of a trolling motor (12) is covering select portions of the ratchet slots (20) with latch-restraint plates (45) to allow free-hand tilting to maneuver through water obstacles or to tilt-lock the trolling motor (12) only at most preferable positions for trolling, for trailering and storage, and for passing over water obstacles selectively.

19 Claims, 3 Drawing Sheets

TROLL MOTOR TILT TRIGGER

BACKGROUND OF THE INVENTION

This invention relates to controlling tilt or inclination of troll motors on transoms of trolling boats.

Currently, tilt of troll motors on trolling-boat transoms is controlled by disengaging a spring-pressured tilt latch from a quarter-circle tilt ratchet on a transom clamp. A latch-disengagement rod is extended upwardly from a top surface of the transom clamp and has a push-bottom knob that is accessed manually by reaching rearwardly and downwardly over the transom and transom clamp. There, the push-button knob is pushed downwardly with one hand of an individual in opposition to spring pressure to release the tilt latch. The other hand of the individual must be used to tilt a troll-motor rod from one latch-set verticality to a selectively slanted latch-set verticality or to a latch-set horizontal attitude as desired.

Releasing a transom latch by reaching over a transom and transom clamp with one hand while adjusting slant of a troll-motor rod with the other hand is doable but dangerous, inconvenient, difficult and distracting from troll fishing. Mechanisms for it are similarly standard and cause similar problems on most troll motors.

To operate present tilt-control mechanisms, an individual must either stand or lean from a sitting position in ways that can destabilize small boats on which troll motors are used. Before standing or leaning, however, the individual must free both hands, which often involves setting down or releasing a fishing rod, a fishing line or setting down a sandwich or a drink. Highly significant also, a high degree of attention of the individual must be diverted from fishing and other activities to operate the present mechanisms. Some people who like to fish do not like to be distracted or endangered to control slant or verticality of a troll-motor rod when necessary to maneuver water-bottom obstruction in variously shallow or deep water when troll fishing. Others simply do not have sufficient dexterity. Still others may be disabled or flail with age and yet like to troll fish but are unable to handle present tilt-control mechanisms. Even the strong are often endangered when a wave or wind gust might occur while they are in a destabilizing position over a transom.

Typical use conditions compound problems of present tilt-control mechanisms. Most often when obstacles in water are encountered, an individual is engaged in troll-fishing activities or snacking and does not want to divert any more mental or physical capacity than absolutely necessary for changing inclination of a troll-motor rod to maneuver them. At ends of trolling activities also, the individual does not want to face the same problems when tilting the troll-motor rod to a horizontal inclination for raising a troll motor above water.

Examples of other different but related tilt controls for trolling motors are described in the following patent documents. U.S. Pat. No. 4,734,068, issued to Edwards, is limited to use of an arcuate slot in an outboard-motor mounting structure. U.S. Pat. No. 4,033,530, issued to Harris, described an outboard mounting assembly with a form of spring resistance to obstructions in water. U.S. Pat. No. 3,954,080, issued to Weaver, taught a bow mount with a lock pin positioning a motor tube in vertical or horizontal position. Still other known mounting devices are further yet different.

SUMMARY OF THE INVENTION

In light of need for improvement of controlling tilt of trolling motors on trolling boats objects of this invention are to provide a troll-motor tilt trigger which:

Requires only one hand for adjusting tilt of a troll motor;

Can be operated from a sitting position on a boat without having to stand or to bend over a mounting clamp;

Can be produced as either an aftermarket add-on or as original equipment manufacture;

Is easy and inexpensive to install as an aftermarket item; and

Avoids danger of body shifting in a boat for operation.

This invention accomplishes these and other objectives with a troll-motor tilt trigger having a trigger lever with a fulcrum axis of the trigger lever attached pivotally to a steering housing which is pivotal vertically on a troll-motor clamp. A distal end of the trigger lever is positioned to press a hand-press end of a latch-release rod of a tilt-control ratchet on the troll-motor clamp. A proximal end of the trigger lever is extended outwardly from the troll-motor clamp for actuation by a ratchet-release line. A handle end of the ratchet-release line can be contained slidingly by a line keeper through which the ratchet-release line is routed to a desired portion of a steering handle of a troll motor on a troll-motor rod that is clamped to a boat with the troll-motor clamp. A release handle is attached to a proximal end of the ratchet-release line. The ratchet-release line is pulled for pressing the distal end of the trigger lever against the hand-press end of the latch-release rod in order to disengage a ratchet latch on the ratchet-release rod from a ratchet slot. This allows the troll-motor rod that is pivotal vertically on the troll-motor clamp to be tilted between verticality with a troll motor in a horizontal attitude and a horizontal attitude with the troll motor vertical at approximately clamp height and out of water. Selectively between horizontal and vertical attitudes, the troll-motor rod can be tilted between verticality to a desired latching angle of tilt to raise and lower the troll motor in relation to obstacles in the water when the ratchet-release line is pulled. A ratchet cover can be positioned on ratchet slots not desired to be used between vertical and horizontal latching of the troll-motor rod with the tilt-control ratchet.

The above and other objects, features and advantages of the present invention should become even more readily apparent to those skilled in the art upon a reading of the following detailed description in conjunction with the drawings wherein there is shown and described illustrative embodiments of the invention.

BRIEF DESCRIPTION OF DRAWINGS

This invention is described by appended claims in relation to description of a preferred embodiment with reference to the following drawings which are described briefly as follows:

DESCRIPTION OF PREFERRED EMBODIMENT

Figure 1:
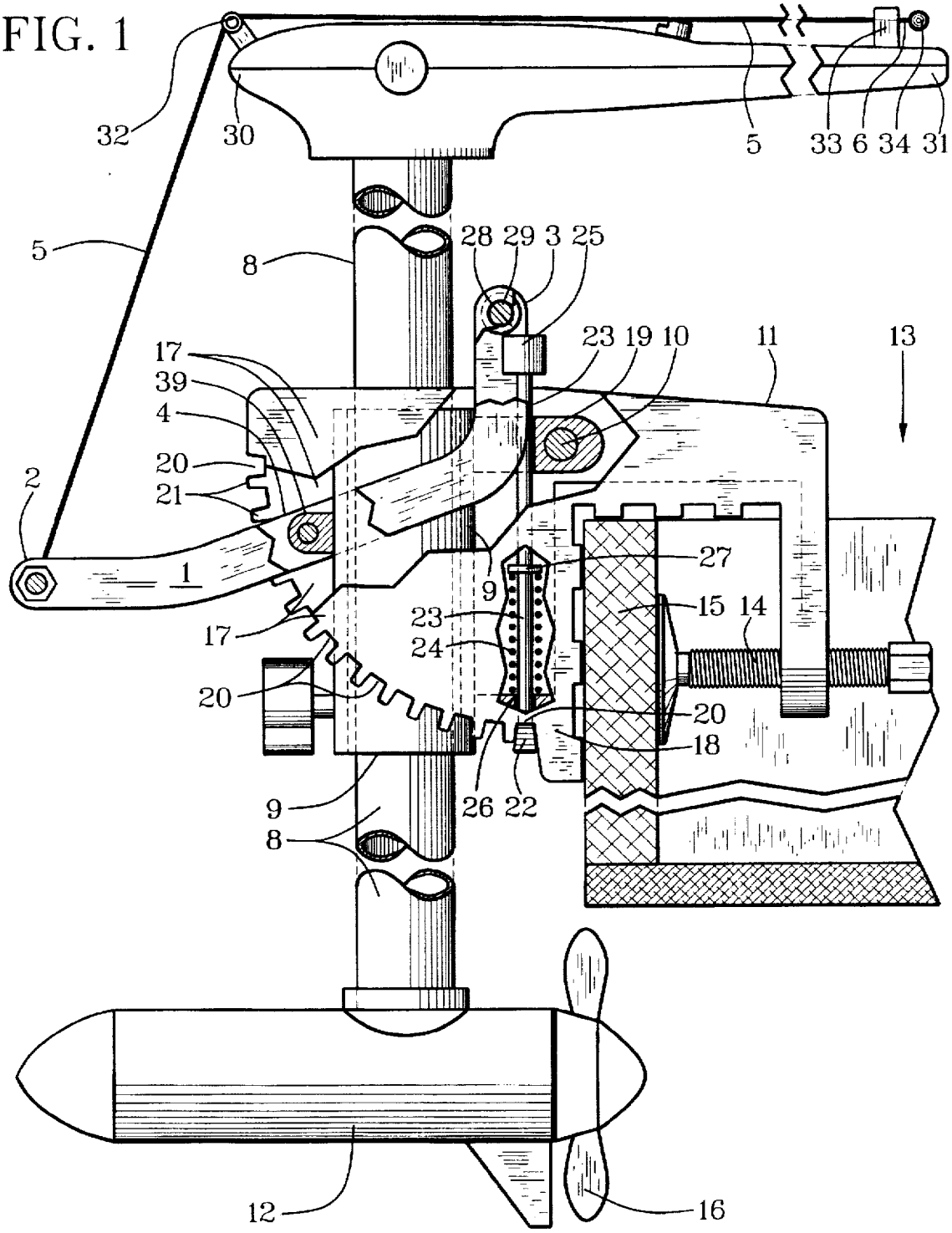
FIG. 1 is a partially cutaway side elevation view of a trolling motor with the trip trigger device of this invention.

For purposes of describing the preferred embodiment, the terminology used in reference to the numbered components in the drawings is as follows:

| | | |
|---|---|---|
| 1. trigger lever | 18. clamp plate | 33. line keeper |
| 2. line-attachment end | 19. housing front portion | 34. line handle |
| 3. latch-release end | 20. ratchet slots | 35. spreader sleeve |
| 4. fulcrum section | 21. ratchet ridges | 36. attachment ring |
| 5. latch-release line | 22. cross-bar latch | 37. rigid bifurcation |
| 6. handle end | 23. latch-release rod | 38. attachment aperture |
| 7. steering handle | 24. latch spring | 39. fulcrum base |
| 8. troll-motor rod | 25. press end of latch-release rod | 40. fulcrum axle |
| 9. steering housing | 26. bottom rod bearing | 41. base housing |
| 10. tilt axle | 27. spring keeper | 42. base axle |
| 11. troll-motor clamp | 28. release roller | 43. fulcrum housing |
| 12. troll motor | 29. release axle | 44. unitary lever press |
| 13. trolling boat | 30. rod end of steering handle | 45. latch-restraint plate |
| 14. plate bolts | 31. handle end of steering handle | 46. threaded fastener bolt |
| 15. transom | 32. line pulley | 47. attachment plates |
| 16. water screw | | 48. plate fastener |
| 17. juxtaposed ratchet plates | | |

Reference is made first to FIGS. 1–4. A trigger lever 1 has a line-attachment end 2, a latch-release end 3 and a fulcrum section 4 intermediate the line-attachment end 2 and the latch-release end 3. A latch-release line 5 has a distal end attached to the line-attachment end 2 of the trigger lever 1 and a handle end 6 extended to a steering handle 7 on a troll-motor rod 8 that is rotational horizontally in a steering housing 9 that is pivotal vertically on a tilt axle 10 on a troll-motor clamp 11.

The trigger lever 1 is attached to a conventional troll-motor assembly to provide ease, convenience and safety of tilting a troll motor 12 on a bottom end of the troll-motor rod 8 in and out of water to troll-fish, to circumvent obstacles in water and to position the troll-motor rod 8 in horizontal attitude for trailering and for storing a trolling boat 13.

A conventional troll-motor assembly has a troll-motor clamp 11 with plate bolts 14 that are screwed against a transom 15 or a stern plate of some types of trolling boats 13. The troll-motor rod 8 is rotational or selectively pivotal in the steering housing 9 for directing thrust of a water screw 16 horizontally in water. Linearly fixing of the troll-motor rod 8 in the steering housing 9 while allowing rotation of the troll-motor rod 8 in relation to the steering housing 9 is achieved with several known methods that are represented generally with a double wall of the steering housing 9 external to the troll-motor rod 8.

To control tilt of the steering housing 9, conventional troll-motor assemblies have juxtaposed ratchet plates 17 extended from a clamp plate 18 on opposite sides of the steering housing 9. The steering housing 9 pivots vertically on the tilt axle 10 with which the steering housing 9 is attached pivotally to the troll-motor clamp 11 at a housing from portion 19. Pluralities of ratchet slots 20 between ratchet ridges 21 are provided on quarter-circle edges of the juxtaposed ratchet plates 17 for containing a cross-bar latch 22.

A latch-release rod 23 is attached to the cross-bar latch 22 and extended intermediate a top of the housing front portion 19 and a bottom of the housing front portion 19. The latch-release rod 23 is colinear to and in sliding contact with the housing front portion 19. The cross-bar latch 22 on a latch end of the latch-release rod 23 is spring-pressured into juxtaposed-plate pairs of the ratchet slots 20 in the quarter-circle edges of the juxtaposed ratchet plates 17 with a latch spring 24 having spring pressure directed in a latch-entry direction of travel of the cross-bar latch 22 towards juxtaposed-plate pairs of ratchet slots 20.

The spring pressure is in opposition to pressing of a press end 25 of the latch-release rod 23 with the ratch-release end 3 of the trigger lever 1 by pulling upwardly on the latch-release line 5 to remove the cross-bar latch 22 from juxtaposed-plate pairs of ratchet slots 20. This allows unlatched tilting of the steering housing 9 in order to tilt a troll-motor rod 8 for tilt-raising and for tilt-lowering of a troll motor 12 on a bottom of the troll-motor rod 8.

A variety of known spring-pressure methods can be employed for the latch spring 24. One known method is for the latch spring 24 to be an expansion spring with expansion presser exerted between a bottom rod bearing 26 and a spring keeper 27 on the latch-release rod 23.

The trigger lever 1 can be curved variously for positioning the latch-release end 3 designedly above an edge of the press end 25 of the latch-release rod 23. This positions a release roller 28 on a release axle 29 to roll forwardly and downwardly while pressing the press end 25 to release the cross-bar latch 22 from juxtaposed-plate pairs of ratchet slots 20 and thereby to allow vertical pivoting of the steering housing 9.

Positioning of the latch-release line 5 in relationship to the steering handle 7 can be either proximate a handle base 30, proximate a handle end 31 or wherever preferred for ease of grasping. Positioning at a handle end 31 at the handle base 30 can be aided by a line pulley 32 and by a line keeper 33 proximate the handle end 31. A line handle 34 can be provided for grasping the latch-release line 5 and the handle end 31 of the steering handle 7 simultaneously with one hand for tilting action without standing, leaning or otherwise shifting bodily position or interfering significantly with other activities. This is in contrast to conventional tilting action that requires all or some portion of these boating dangers and inconveniences.

Figure 2:
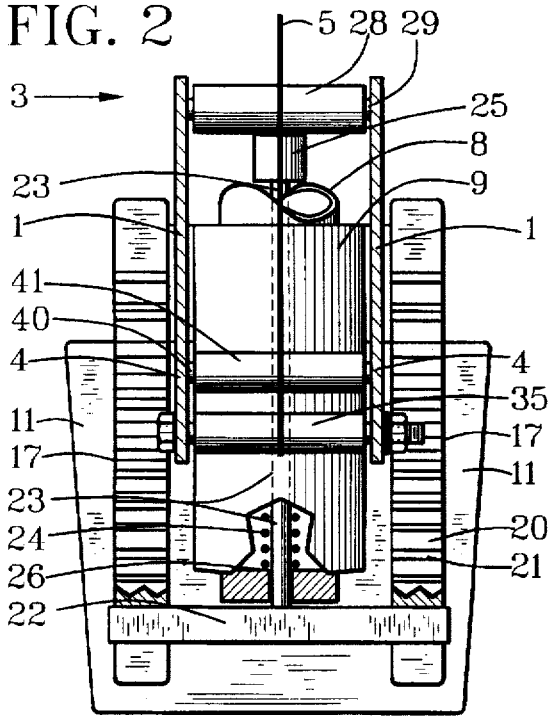
FIG. 2 is a partially cutaway sectional rear view.
Figure 4:
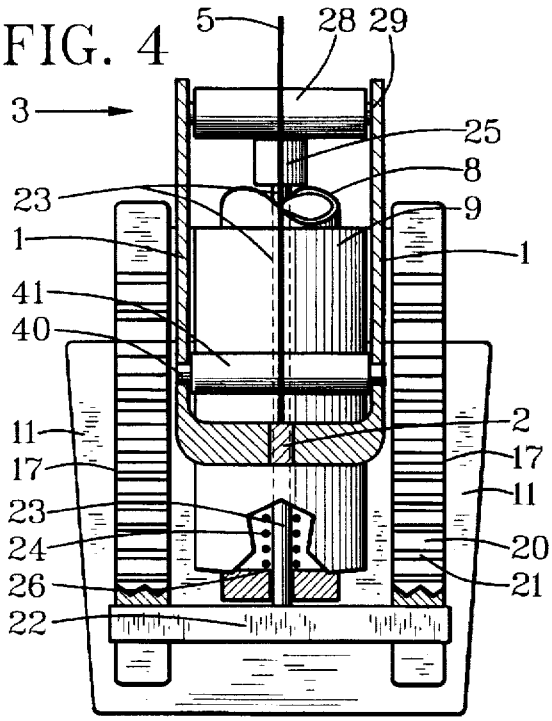
FIG. 4 is a partially cutaway sectional rear view with a bifurcated trigger lever.
Figure 4:
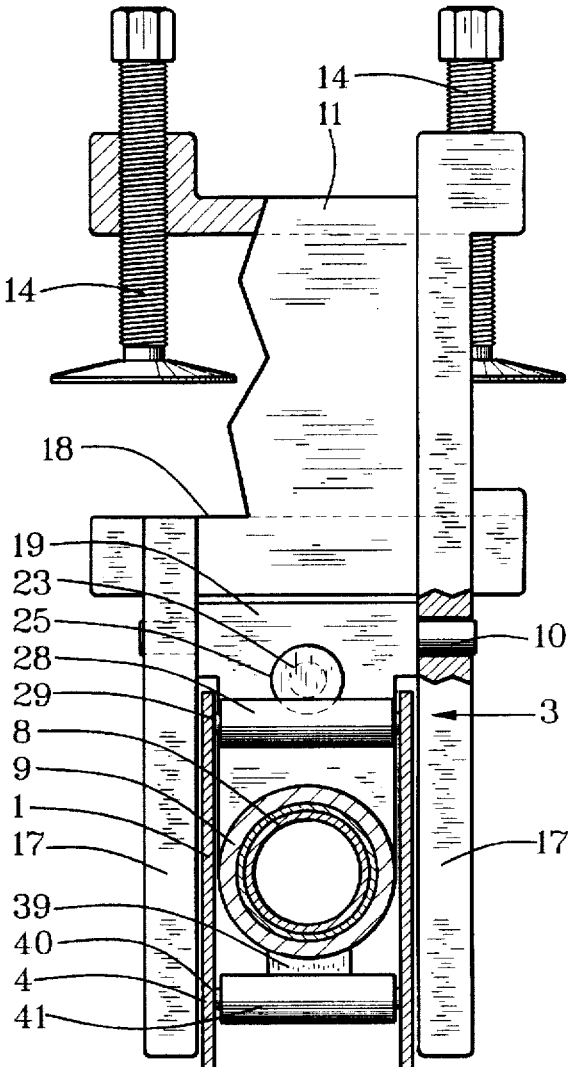
Figure 3:
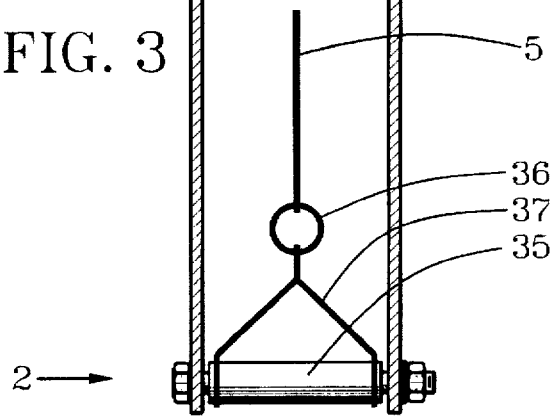
FIG. 3 is a partially cutaway sectional top view.
Figure 7:
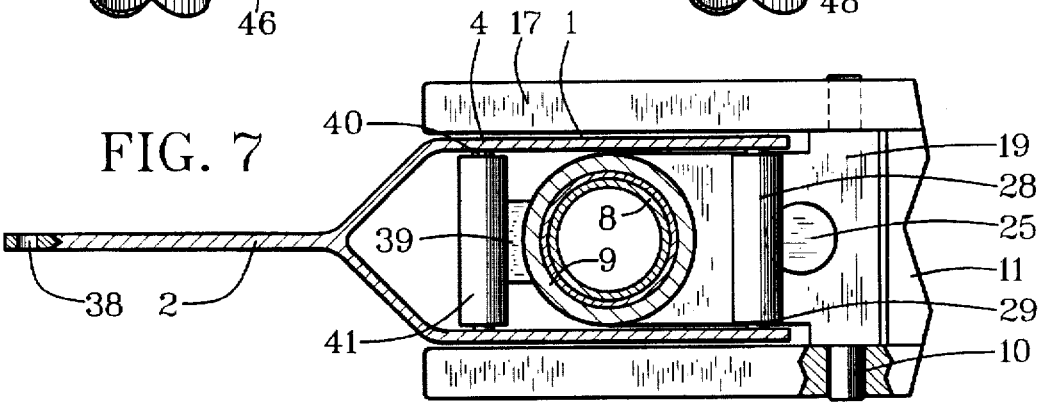
FIG. 7 is a partially cutaway top sectional view with a bifurcated line-attachment end.
Figure 8:
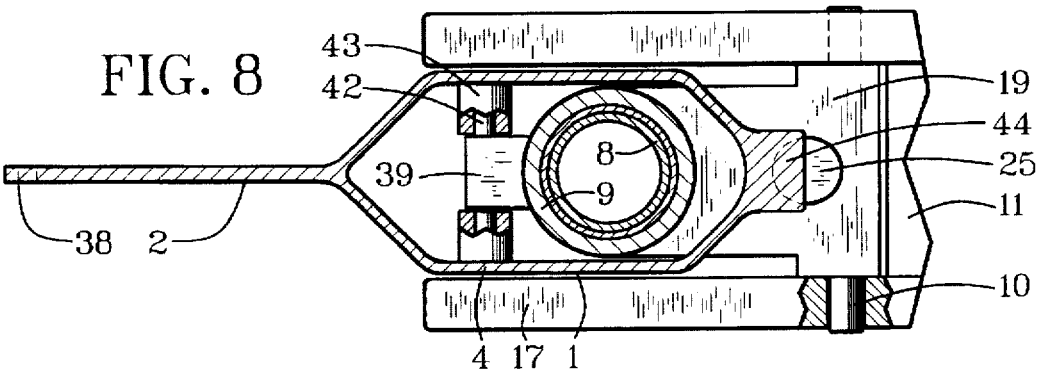
FIG. 8 is a partially cutaway top sectional view of an opposed-bifurcation trigger lever.

Referring to FIGS. 1–4 and 7–8, the trigger lever 1 is a pair of lever plates at a portion of the trigger lever 1 which bypasses opposite sides of the steering housing 9 as depicted more clearly in FIGS. 2–4 and 7–8. However, the line-attachment end 2 of the trigger lever 1 can be unitary as depicted in FIGS. 4, and 7–8 or binary as depicted in FIGS. 1–3.

A binary line-attachment end 2 can be separated by a spreader sleeve or attachment rod 35 as depicted in FIG. 3.

The latch-release line 5 can be attached conveniently to the trigger lever 1 with such means as an attachment ring 36 and a rigid bifurcation 37 as shown in FIG. 3. For a unitary trigger lever 1, a simple attachment aperture 38 in the line-attachment end 2, as shown in FIGS. 7–8, can be employed for attachment of the latch-release line 5 shown in FIGS. 1–4.

The fulcrum section 4 of the trigger lever 1 is attached pivotally to an exterior portion of the steering housing 9 at a fulcrum base 39. The trigger lever 1 can have a fulcrum axle 40 that is rotational in a base housing 41 as depicted in FIG. 7 or the fulcrum base 39 can have base axles 42 that are rotational in fulcrum housings 43 as depicted in FIG. 8. A selection of means for pivotal attachment of the fulcrum section 4 to an exterior portion of the steering housing 9 are foreseeable.

Optional to the release roller 28 on the release axle 29 as depicted in FIGS. 1–4 and 7, a unitary lever press 44 shown in FIG. 8 can be employed on trigger levers 1 having either unitary or binary line-attachment ends 2. A unitary lever press 44 on a trigger lever 1 with a unitary line-attachment end 2 can be referred to as an opposed bifurcation, an opposed Y-shape or an oval trigger lever 1 with unitary ends.

Shape and form of trigger lever 1 can be varied designedly in relationship to types, sizes and shapes of troll-motor assemblies on which the trigger lever 1 is employed. It can be varied also in relationship to positioning of the fulcrum base 39 at a design side of the steering housing 9 and at a design height vertically in relationship to the steering housing 9 and the press end 25 of the of the latch-release rod 23.

Figure 5:
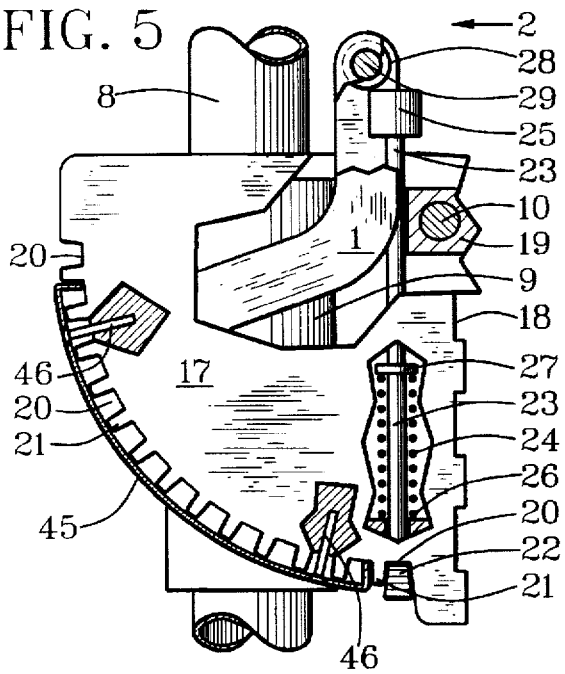
FIG. 5 is a partially cutaway sectional side view with a latch-restraint plate between a bottom slot for vertical attitude and a top slot for horizontal attitude of a troll-motor rod.
Figure 6:
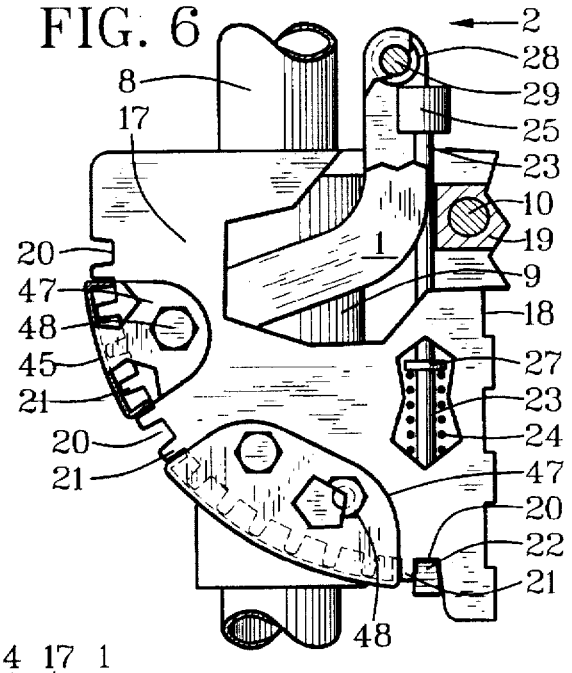
FIG. 6 is a partially cutaway sectional side view with a latch-restraint plate over all slots except a bottom, a top and a middle slot.

Referring to FIGS. 5–6, latch-restraint plates 45 are positioned on tops of ratchet ridges 21 and extended over select portions of the plurality of ratchet slots 20 on the quarter-circle edges of the juxtaposed ratchet plates 17 to prevent entry of the cross-bar latch 22 into the select portions of the pluralities of ratchet slots 20. The select portions of the pluralities of ratchet slots 20 covered can be all but bottom ratchet slots 20 and top ratchet slots 20 as depicted in FIG. 5. Alternatively, the latch-restraint plates 45 can be made to cover all but select middle ratchet slots 20 in addition to the top and bottom ratchet slots 20 as shown in FIG. 6.

Covering all but the top and bottom ratchet slots 20 allows free tilting up and down while maneuvering water obstacles and then locking into either trolling mode with the bottom ratchet slot 20 or into travel and storage mode with the top ratchet slot 20.

As shown in FIG. 5, the latch-restraint plates 45 can be attached with such means as a threaded fastener bolt 46 that is inserted into a bolt aperture in a ratchet-restraint plate 45 and then screwed into a threaded bolt hole in an edge of a juxtaposed ratchet plate 17. The latch-restraint plates 45 are preferably bent at ends to buttress against walls of adjacent ratchet ridges 21.

Alternatively as shown in FIG. 6, the latch-restraint plates 45 can have attachment plates 47 that are positioned against walls of the juxtaposed ratchet plates 17 to which they are fastened with a select type of plate fastener 48. A hex bolt is depicted as the plate fastener 48. However, the plate fastener 48 can be a snap fastener for convenient attachment and detachment.

Latch-restraint plates 45 that are sized and shaped to cover different portions of the ratchet slots 20 are foreseeable.

Also foreseeable is construction of steering housings 9 with a sufficiently long front portion 19 for positioning the fulcrum base 39 on a forward side of the steering housing 9. Construction of the trigger lever 1 and the fulcrum base 39 accordingly is foreseeable and included within the scope of this invention.

A new and useful troll-motor tilt trigger having been described, all such foreseeable modifications, adaptations, substitutions of equivalents, mathematical possibilities of combinations of parts, pluralities of parts, applications and forms thereof as described by the following claims and not precluded by prior art are included in this invention.

I claim:

1. A troll-motor tilt trigger comprising:

a fulcrum base on an exterior portion of a steering housing in which a troll-motor rod is pivotal horizontally for directing thrust of a water screw rotated by a troll motor attached to a bottom end of the troll-motor rod;

a trigger lever having a line-attachment end, a latch-release end and a fulcrum section that is intermediate the line-attachment end and the latch-release end;

the line-attachment end being on an aft side of the steering housing, the latch-release end being proximate a press end of a latch-release rod that is slidable collinearly with the steering housing at a forward side of the steering housing, and the fulcrum section being pivotal on the fulcrum base on an exterior portion of the steering housing; and a ratchet-release line having a lever end attached to the line-attachment end of the trigger lever and the ratchet-release line having a handle end that is extended to proximate a steering handle on a top portion of the troll-motor rod.

2. A troll-motor tilt trigger as described in claim 1 and further comprising:

latch-restraint plates that are positioned on tops of ratchet ridges and extended over select portions of a plurality of ratchet slots on quarter-circle edges of juxtaposed ratchet plates extended from a troll-motor clamp at opposite sides of the steering housing, such that entry of a cross-bar latch into the select portions of the pluralities of ratchet slots is prevented.

3. A troll-motor tilt trigger as described in claim 2 wherein:

the select portions of the pluralities of ratchet slots are all ratchet slots intermediate bottom ratchet slots with which the latch-release rod and the troll-motor rod on which it is positioned collinearly in sliding contact are maintained in a vertical attitude for a motor-down mode and top ratchet slots with which the latch-release rod and the troll-motor rod are maintained in a horizontal attitude for a motor-up mode, such that the troll-motor rod can be pivoted upwardly and downwardly to raise and lower a troll motor in relation to water obstructions or positioned in either the motor-up mode or the motor-down mode selectively without inconvenience of being locked into intermediate sets of ratchet slots.

4. A troll-motor tilt trigger as described in claim 2 wherein:

the select portions of the plurality of ratchet slots over which latch-restraint plates are extended to prevent entry of the cross-bar latch are all ratchet slots except bottom ratchet slots, top ratchet slots and middle ratchet slots on the quarter-circle edges of the juxtaposed ratchet plates, such that entry of the cross-bar latch into all ratchet slots except ratchet slots with which the latch-release rod and the troll-motor rod are maintained in a motor-down mode, a motor-above-water mode and a motor-storage mode selectively.

5. A troll-motor tilt trigger comprising:

a fulcrum base on an exterior portion of a steering housing in which a troll-motor rod is pivotal horizontally for directing thrust of a water screw rotated by a troll motor attached to a bottom end of the troll-motor rod;

a trigger lever having a line-attachment end, a latch-release end and a fulcrum section that is intermediate the line-attachment end and the latch-release end;

the line-attachment end being on an aft side of the steering housing, the latch-release end being proximate a press end of a latch-release rod that is slidable collinearly with the steering housing at a forward side of the steering housing, and the fulcrum section being pivotal on the fulcrum base on an exterior portion of the steering housing;

the fulcrum section being pivotal on the fulcrum base in a fulcrum-pivot axis that is orthogonal to an axis of rotation of the troll-motor rod in the steering housing;

the fulcrum-pivot axis being parallel to a tilt axle on which the steering housing is pivotal vertically on a troll-motor clamp;

a ratchet-release line having a lever end attached to the line-attachment end of the trigger lever and the ratchet-release line having a handle end that is extended to proximate a steering handle on a top portion of the troll-motor rod;

the troll-motor clamp having juxtaposed ratchet plates with pluralities of ratchet slots on quarter-circle edges of the juxtaposed ratchet plates;

the juxtaposed ratchet plates being extended orthogonally from an attachment plate on the troll-motor clamp at opposite sides of the steering housing;

a cross-bar latch on a latch end of the latch-release rod being spring-pressured into juxtaposed-plate pairs of slots in the quarter-circle edges of the juxtaposed ratchet plates with a latch spring having spring pressure directed in a latch-entry direction of travel of the cross-bar latch towards juxtaposed-plate pairs of ratchet slots in the quarter-circle edges of the juxtaposed ratchet plates; and the spring pressure is in opposition to pressing of the press end of the latch-release rod with the latch-release end of the trigger lever by pulling upwardly on the latch-release line to remove the cross-bar latch from juxtaposed-plate pairs of ratchet slots for allowing unlatched tilting of the steering housing in order to tilt a troll-motor rod for lowering a troll motor on a bottom end of a troll-motor rod with verticality of the troll-motor rod and for raising a troll motor on a bottom end of a troll-motor rod with horizontal positioning of the troll-motor rod selectively.

6. A troll-motor tilt trigger as described in claim 5 wherein:

the trigger lever has a first lever plate and a second lever plate that are parallel intermediate the line-attachment end and the latch-release end of the trigger lever.

7. A troll-motor tilt trigger as described in claim 6 wherein:

the fulcrum section has a fulcrum axle intermediate the first lever plate and the second lever plate;

the fulcrum base has a base axle housing intermediate the first lever plate and the second lever plate; and the fulcrum axle is pivotal on the base axle housing.

8. A troll-motor tilt trigger as described in claim 6 wherein:

the fulcrum section has a fulcrum housing in two concentric pieces separated for entry of a fulcrum base intermediate the first lever plate and the second lever plate;

the fulcrum base has a base axle extended from opposite sides of the fulcrum base; and the fulcrum housing is pivotal on the base axle.

9. A troll-motor tilt trigger as described in claim 6 and further comprising:

a release bar extended intermediate a latch-release end of the first lever plate and a latch-release end of the second lever plate.

10. A troll-motor tilt trigger as described in claim 9 and further comprising:

a release roller that is rotatable on the release bar.

11. A troll-motor tilt trigger as described in claim 6 and further comprising:

an attachment rod extended intermediate a line-attachment end of the first lever plate and a line-attachment end of the second lever plate.

12. A troll-motor tilt trigger as described in claim 5 wherein:

the handle end of the ratchet-release line is extended to a grasping position proximate a control end of the steering handle.

13. A troll-motor tilt trigger as described in claim 12 and further comprising:

a hand-grasp handle on the handle end of the ratchet-release line.

14. A troll-motor tilt trigger as described in claim 5 and further comprising:

latch-restraint plates that are positioned on tops of ratchet ridges and extended over select portions of the plurality of ratchet slots on the quarter-circle edges of the juxtaposed ratchet plates to prevent entry of the cross-bar latch into the select portions of the pluralities of ratchet slots.

15. A troll-motor tilt trigger as described in claim 14 wherein:

the select portions of the pluralities of ratchet slots are all ratchet slots intermediate bottom ratchet slots with which the latch-release rod and the troll-motor rod on which it is positioned collinearly in sliding contact are maintained in a vertical attitude for a motor-down mode and top ratchet slots with which the latch-release rod and the troll-motor rod are maintained in a horizontal attitude for a motor-up mode, such that the troll-motor rod can be pivoted upwardly and downwardly to raise and lower a troll motor in relation to water obstructions or positioned in either a motor-up mode or a motor-down mode selectively without inconvenience of being locked into intermediate sets of ratchet slots.

16. A troll-motor tilt trigger as described in claim 14 wherein:

the select portions of the plurality of ratchet slots over which latch-restraint plates are extended to prevent entry of the cross-bar latch are all ratchet slots except bottom ratchet slots, top ratchet slots and middle ratchet slots on the quarter-circle edges of the juxtaposed ratchet plates, such that entry of the cross-bar latch into all ratchet slots except ratchet slots with which the latch-release rod and the troll-motor rod are maintained in a motor-down mode, a motor-above-water mode and a motor-storage mode selectively.

17. A troll-motor tilt trigger as described in claim 14 wherein:

the latch-restraint plates are attachable to the quarter-circle portions of the ratchet plates at outside ends of slot ridges with fasteners in fastening communication between the latch-restraint plates and the quarter-circle portions of the ratchet plates.

18. A troll-motor tilt trigger as described in claim 17 wherein:

the fasteners are threaded bolts that are threadable into bolt holes in bottoms of the ratchet ridges and countersunk bolt heads are positioned in countersunk bolt orifices in the latch-restraint plates.

19. A troll-motor tilt trigger as described in claim 17 wherein:

the latch-restraint plates have side walls with fasteners extended orthogonally into walls of the juxtaposed ratchet plates.

* * * * *